US005851966A

United States Patent [19]

Baker et al.

[11] Patent Number: 5,851,966

[45] Date of Patent: Dec. 22, 1998

[54] REACTION PRODUCTS OF SUBSTITUTED CARBOXYLIC ACYLATING AGENTS AND CARBOXYLIC REACTANTS FOR USE IN FUELS AND LUBRICANTS

[75] Inventors: Mark R. Baker, Lyndhurst; Paul E. Adams, Willoughby Hills; Jeffry G. Dietz, University Hts., all of Ohio

[73] Assignee: The Lubrizol Corporation, Wickliffe, Ohio

[21] Appl. No.: 870,350

[22] Filed: Jun. 5, 1997

[51] Int. Cl.[6] ..... C10M 145/00

[52] U.S. Cl. ..... 508/452; 508/454; 508/232; 525/284; 525/285; 525/298; 525/301; 525/309; 525/327.4; 525/333.6; 525/386; 525/387; 525/416; 548/546; 548/547

[58] Field of Search ..... 508/232, 452, 508/454; 525/284, 285, 298, 327.4, 333.7, 386, 301, 387, 309, 416; 548/546, 547

[56] References Cited

U.S. PATENT DOCUMENTS

| | | | |
|---|---|---|---|
| 3,868,330 | 2/1975 | Meinhardt | 508/232 |
| 4,670,173 | 6/1987 | Hayashi et al. | 508/233 |
| 4,686,054 | 8/1987 | Wisotsky et al. | 508/232 |
| 4,780,111 | 10/1988 | Dorer | 44/386 |
| 5,221,491 | 6/1993 | Roper et al. | 508/454 |
| 5,625,004 | 4/1997 | Harrison et al. | 508/232 |
| 5,646,098 | 7/1997 | Brois | 508/189 |
| 5,696,067 | 12/1997 | Adams | 508/476 |

FOREIGN PATENT DOCUMENTS

| | | |
|---|---|---|
| 698656 | 2/1996 | European Pat. Off. . |

*Primary Examiner*—Jacqueline V. Howard
*Assistant Examiner*—Cephia D. Toomer
*Attorney, Agent, or Firm*—Beverly A. Pawlikowski; David M. Shold; Krishna G. Banerjee

[57] ABSTRACT

Compositions of matter for use in oils and fuels are disclosed. The compositions arise from reaction products (C) formed by reacting substituted carboxylic acylating agents (A) with carboxylic reactants (B). The reactant (A) is usually a polyolefin substituted succinic anhydride or acid which is reacted with (B). (B) is usually a glyoxylic compound. Carboxylic reaction products (C) may further be reacted to form succinimide dispersants, esters or other derivatives. Products (C) may also be reacted with an α-β unsaturated compound to form second carboxylic reaction products.

22 Claims, No Drawings

REACTION PRODUCTS OF SUBSTITUTED CARBOXYLIC ACYLATING AGENTS AND CARBOXYLIC REACTANTS FOR USE IN FUELS AND LUBRICANTS

FIELD OF THE INVENTION

This invention relates to reaction products formed by reacting substituted carboxylic acylating agents with carboxyl reagents. The reaction products are further reacted with various types of compounds to form derivatives. Both the reaction products and derivatives are useful in fuel and lubricant compositions.

BACKGROUND OF THE INVENTION

Numerous types of additives are used to improve lubricating oil and fuel compositions. Such additives include, but are certainly not limited to dispersants and detergents of the ashless and ash-containing variety, oxidation inhibitors, anti-wear additives, friction modifiers, and the like. Such materials are well known in the art and are described in many publications, for example, Smalheer, et al, "Lubricant Additives", Lezius-Hiles Co., Cleveland, Ohio, U.S.A. (1967); M. W. Ranney, Ed., "Lubricant Additives", Noyes Data Corp., Park Ridge, N.J., U.S.A. (1973); M. J. Satriana, Ed., "Synthetic Oils and Lubricant Additives, Advances" Since 1979, Noyes Data Corp., Park Ridge N.J., U.S.A. (1982), W. C. Gergel, "Lubricant Additive Chemistry", Publication 694-320-65R1 of the Lubrizol Corp., Wickliffe, Ohio, U.S.A. (1994); and W. C. Gergel et al, "Lubrication Theory and Practice"Publication 794-320-59R3 of the Lubrizol Corp., Wickliffe, Ohio, U.S.A. (1994); and in numerous United States patents, for example Chamberlin, II, U.S. Pat. No. 4,326,972, Schroeck et al, U.S. Pat. No. 4,904,401, and Ripple et al, U.S. Pat. No. 4,981,602. Many such additives are frequently derived from carboxylic reactants, for example, acids, esters, anhydrides, lactones, and others. Specific examples of commonly used carboxylic compounds used as such and as intermediates for preparing lubricating oil and fuel additives include alkyl-and alkenyl substituted succinic acids and anhydrides, polyolefin substituted carboxylic acids, aromatic acids, such as salicylic acids, and others. Illustrative carboxylic compounds are described in Meinhardt, et al, U.S. Pat. No. 4,234,435; Norman et al, U.S. Pat. No. 3,172,892; LeSuer et al, U.S. Pat. No. 3,454,607 and Rense, U.S. Pat. No. 3,215,707.

Many carboxylic intermediates used in the preparation of lubricating oil additives contain chlorine. While the amount of chlorine present is often only a very small amount of the total weight of the intermediate, the chlorine frequently is carried over into the carboxylic derivative which is desired to be used as an oil or fuel additive. For a variety of reasons, including environmental reasons, the industry has been making efforts to reduce or to eliminate chlorine from additives designed for use as lubricant or fuel additives.

Accordingly, it is desirable to provide low chlorine or chlorine free intermediates which can be used as such in fuels and lubricants or to prepare low chlorine or chlorine free derivatives thereof for use in lubricants and fuels. The present invention provides carboxylic compounds which meet this requirement.

B. B. Snider and J. W. van Straten, J. Org. Chem., 44, 3567–3571 (1979) describe certain products prepared by the reaction of methyl glyoxylate with several butenes and cyclohexenes. K. Mikami and M. Shimizu, Chem. Rev., 92, 1021–1050 (1992) describe carbonyl-ene reactions, including glyoxylate-ene reactions. D. Savostianov (communicated by P. Pascal), C. R. Acad. Sc. Paris, 263, (605–7) (1966) relates to preparation of some α-hydroxylactones via the action of glyoxylic acid on olefins. M. Kerfanto et. al., C. R. Acad. Sc. Paris, 264, (232–5) (1967) relates to condensation reactions of α-α-di-(N-morpholino)-acetic acid and glyoxylic acid with olefins.

European patent publications of Feb. 26, 1997, EP 0759443, EP 0759444 and EP 0759435 assigned to The Lubrizol Corporation, give details of the reaction of olefins with specific carboxylic reactants to produce various reaction products. These European patent publications are incorporated herein by reference in their entirety.

U.S. Pat. No. 4,654,435 describes the reaction of unsaturated organic compounds except rubber, said compounds having at least one carbon-carbon double bond, with organic compounds having a carboxyl group and an aldehyde group in the presence of a Lewis acid.

SUMMARY OF THE INVENTION

This invention is for carboxylic reaction products for use in fuels and lubricants. The carboxylic reaction products (C) result from reacting:

(A) a substituted carboxylic acylating agent and (B) a carboxylic reactant.

The carboxylic reaction products (C) are then further reacted with a reactant selected from the group consisting of (a) an amine characterized by the presence within its structure of at least one H-N<group; (b) an alcohol; (c) a reactive metal or reactive metal compound; (d) a combination of two or more of (a) through (c); the components of (d) being reacted with said carboxylic reaction products (c) simultaneous or in any order. Ammonia and hydrazine are included in this group. U.S. Pat. No. 4,234,435 gives a detailed discussion of the reactions of reagents of said group with carboxylic reactants and is incorporated herein by reference in its entirety.

The substituted carboxylic acylating agents (A) are usually formed by the chlorine catalyzed reaction of an olefin polymer with α-β unsaturated compounds illustrated by the formula $$X-\overset{\overset{\displaystyle O}{\|}}{C}-\overset{|}{C}=\overset{|}{C}-\overset{\overset{\displaystyle O}{\|}}{C}-X' \quad \text{or} \quad X-\overset{\overset{\displaystyle O}{\|}}{C}-\overset{|}{C}=C- \qquad \text{(I)}$$

where X and X' are either the same or different, provided that at least one of X or X' is such that (A) will function as a substituted carboxylic acylating agent when (A) is formed from (I) and an olefin polymer. The preferred embodiments included for formula (I) are maleic acid and maleic anhydride. A full discussion of the compositions encompassed by (A) and formula (I) is found in U.S. Pat. No. 4,234,435 which is incorporated herein by reference in its entirety.

While maleic anhydride is the preferred α-β unsaturated compound (I) to be reacted with a polyolefin, it should be clear that α-β unsaturated monocarboxylic acids or esters are also included, as are their derivatives, as suitable reactants to react with (C). The α-β unsaturated monocarboxylic acids and esters and derivatives thereof include the acrylic acid and ester type compounds among others.

The substituted carboxylic acylating products of this invention are illustrated by the formulas shown below as (II)

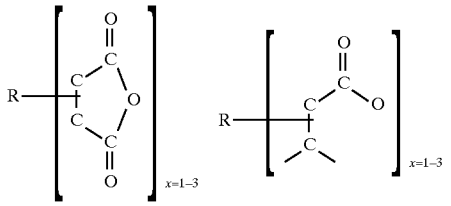

(II)

Carboxylic acylating agents ( II) represents reaction products of α-β unsaturated anhydrides or acids or esters with an olefin where R represents an olefin containing hydrocarbyl groups. Formula (II) is representational only for reactions of olefins with α-β unsaturated acids, esters or anhydrides.

The substituted carboxylic acylating agents (II) may also be formed by direct alkylation of an α-β unsaturated carboxylic acid or anhydride under thermal conditions. The thermal route to compounds illustrated by formula (II) is described in U.S. Pat. Nos. 4,234,435, 4,152,499 and European Patent 0145235 which are incorporated herein by reference in their entirety. The most successful thermal reaction results when a high vinylidene olefin such as polyisobutylene is reacted with maleic anhydride. High vinylidene polyolefins are those with about 30 mole percent or more terminal vinyl groups. With conventional olefins such as polyisobutylene synthesized with a Ziegler catalyst reactive end groups (vinylidene) account for only about 5% of the end groups in the polymer. Chlorine is used to catalyze the reaction of conventional isobutylene with an α-β unsaturated carboxylic compound.

The olefin compound of the substituted carboxylic acylating agent is usually a polyolefin such as polyisobutylene of $\overline{M}_n$200–5,000, but it will be recognized that (R) may be of any desirable molecular weight even up to $\overline{M}_n$500,000 or more and may be a polyolefin, a polyolefin copolymer, a terpolymer or mixtures thereof. A terpolymer is an olefin copolymer in which one of the co-olefin reactants is a diene.

The substituted carboxylic acylating agent (A) is reacted with a carboxylic reactant (B) to produce (C), the carboxylic reaction products of this invention.

Carboxylic reactant (B) is represented by compounds of formula (III) and (IV) shown below:

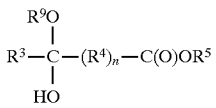

(IV)

wherein each of $R^3$, $R^5$ and $R^9$ is independently H or a hydrocarbyl group, $R^4$ is a divalent hydrocarbylene group, and n is 0 or 1, wherein the ratio of reactants ranges from about 0.5 moles (B) per equivalent of (A), to about 3.0 moles (B) per equivalent of (A).

In reacting (A) with (B) it is thought to be the residual olefin double bonds of (A) which react with the carboxylic reactants (B). The reacting may be optionally acid catalyzed.

It will be recognized that in forming the substituted carboxylic acylating agent (A) from the reaction of an olefin with an α-β unsaturated compound that not all of the olefin may be reacted. The reaction product is then a mixture of the polyolefin and the substituted carboxylic acylating agent (A). The α-β unsaturated compound is usually distilled from the reaction mixture at reduced pressure but the unreacted olefin remains. The unreacted olefin also reacts with the carboxylic reactant (B) in a fashion similarly described in the three EPO patent applications referenced above.

Reaction processes and more detailed descriptions of (A) and (B) are given in the three European patent applications referenced above which are incorporated herein by reference.

The Catalyst

The process of this invention thus is the reaction of (A) with (B) to produce carboxylic reaction product (C) and may be conducted in the presence of an acidic catalyst; however, no catalyst is required.

However, when catalysts are used, yields are sometimes enhanced. Acid catalysts, such as organic sulfonic acids, for example, paratoluene sulfonic acid, methane sulfonic acid, heteropolyacids, the complex acids of heavy metals (e.g., Mo, W, Sn, V, Zr, etc.) with phosphoric acids (e.g., phosphomolybdic acid), and mineral acids, such as sulfuric acid and phosphoric acid. Lewis acids, e.g., $BF_3$, $AlCl_3$ and $FeCl_3$, are useful for promoting "ene" reactions.

When they are used, catalysts are used in amounts ranging from about 0.01 mole % to about 10 mole %, more often from about 0.1 mole % to about 2 mole %, based on moles of olefinic reactant.

The substituted carboxylic acylating agent (A) is described above in the various cited U.S. and European patents having to do with chlorine catalyzed and direct alkylation of α-β unsaturated acids or anhydrides with olefins.

The olefinic compound employed to react with the α-β unsaturated carboxylic compounds (I) to produce (A) is represented by formula (V), $$(R^1)(R^2)C{=}C(R^6)(CH(R^7)(R^8)) \quad (V)$$

wherein each of $R^1$ and $R^2$ is, independently, hydrogen or a hydrocarbon based group and each of $R^6$, $R^7$ and $R^8$ is, independently, hydrogen or a hydrocarbon based group provided that at least one is a hydrocarbon based group containing at least 7 carbon atoms. These olefinic compounds are diverse in nature.

Virtually any compound containing an olefinic bond may be used provided it meets the general requirements set forth hereinabove for (V) and does not contain any functional groups (e.g., primary or secondary amines) that would interfere with the reaction with (I), the α-β unsaturated carboxylic compound. Useful olefinic compounds may be terminal olefins, i.e., olefins having a $H_2C{=}C$ group, or internal olefins. Useful olefinic compounds may have more than one olefinic bond, i.e., they may be dienes, trienes, etc. Most often, they are mono-olefinic. Examples include linear a-olefins, cis- or trans- disubstituted olefins, trisubstituted and tetrasubstituted olefins.

When (V) is a mono-olefin, one mole of (A) contains one equivalent of C═C; when (V) is a di-olefin, one mole of (A) contains 2 equivalents of C═C bonds; when (V) is a tri-olefin, one mole of (A) contains 3 equivalents of C═C bonds, and so forth.

Aromatic double bonds are not considered to be olefinic double bonds within the context of this invention.

As used herein, the expression "polyolefin" defines a polymer derived from olefins. The expression "polyolefinic" refers to a compound containing more than one C═C bond. An olefin copolymer is one in which at least two olefins contribute to the polymer. A terpolymer is one in which one of the reactants which form the polymer is a diene.

Among useful compounds are those that are purely hydrocarbon, i.e., those substantially free of non-hydrocarbon groups, or they may contain one or more non-hydrocarbon groups as discussed in greater detail herein.

In one embodiment, the olefinic compounds are substantially hydrocarbon, that is, each R group in (V) is H or contains essentially carbon and hydrogen. In one aspect within this embodiment, each of $R^1$, $R^2$, $R^7$ and R8 is hydrogen and $R^6$ is a hydrocarbyl group containing from 7 to about 5,000 carbon atoms, more often from about 30 up to about 200 carbon atoms, preferably from about 50 up to about 100 carbon atoms. In another aspect of this embodiment, each of $R^1$ and $R^2$ is hydrogen, $R^6$ is H or a lower alkyl group and the group $(CH(R^7)(R^8))$ is a hydrocarbyl group containing from 7 to about 5,000 carbon atoms, more typically from about 30 up to about 200 carbon atoms, preferably from 50 up to about 100 carbon atoms. In yet another aspect of the invention, the olefins are α-olefins containing from about 8, often from about 12 up to about 28, often up to about 18 carbon atoms.

In another embodiment, one or more of the R groups present in (V) is an organic radical which is not purely hydrocarbon. Such groups may contain or may be groups such as carboxylic acid, ester, amide, salt, including ammonium, amine and metal salts, cyano, hydroxy, thiol, tertiary amino, nitro, alkali metal mercapto and the like. Illustrative of olefinic compounds (V) containing such groups are methyl oleate, oleic acid, 2-dodecenedioic acid, octene diol, linoleic acid and esters thereof, and the like.

Preferably, the hydrocarbyl groups are aliphatic groups. In one preferred embodiment, when an R group is an aliphatic group containing a total of from about 30 to about 100 carbon atoms, the olefinic compound is derived from homopolymerized and interpolymerized $C_{2-28}$ mono- and di-olefins, preferably 1-olefins, especially those containing from 2 to about 5 carbon atoms, preferably 3 or 4 carbon atoms. Examples of such olefins are ethylene, propylene, butene-1, isobutylene, butadiene, isoprene, 1-hexene, 1-octene, etc. R groups can, however, be derived from other sources, such as monomeric high molecular weight alkenes (e.g., 1-tetracontene), aliphatic petroleum fractions, particularly paraffin waxes and cracked analogs thereof, white oils, synthetic alkenes such as those produced by the Ziegler-Natta process (e.g., poly-(ethylene) greases) and other sources known to those skilled in the art. Any unsaturation in the R groups may be reduced by hydrogenation according to procedures known in the art, provided at least one olefinic group remains, as described for (V).

In one preferred embodiment, at least one R is derived from polybutene, that is, polymers of $C_4$ olefins, including 1-butene, 2-butene and isobutylene. Those derived from isobutylene, i.e., polyisobutylenes, are especially preferred. In another preferred embodiment, R is derived from polypropylene. In another preferred embodiment, R is derived from ethylene-alpha olefin polymers, particularly ethylene-propylene polymers and ethylene-alpha olefin-diene, preferably ethylene-propylene -diene polymers. Molecular weights of such polymers may vary over a wide range but especially those having number average molecular weights ($\overline{M}_n$) ranging from about 300 to about 20,000, preferably 700 to about 5,000. In one preferred embodiment the olefin is an ethylene-propylene-diene copolymer having $\overline{M}_n$ ranging from about 900 to about 2500. An example of such materials are the Trilene® polymers marketed by the Uniroyal Company, Middlebury, Conn., U.S.A.

A preferred source of hydrocarbyl groups R are polybutenes obtained by polymerization of a $C_4$ refinery stream having a butene content of 35 to 75 weight percent and isobutylene content of 15 to 60 weight percent in the presence of a Lewis acid catalyst such as aluminum trichloride or boron trifluoride. These polybutenes contain predominantly (greater than 80% of total repeating units) isobutylene repeating units of the configuration

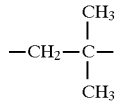

These polyisobutylenes are typically monoolefinic, that is, they contain but one olefinic bond per molecule.

The olefinic compound may be a polyolefin comprising a mixture of isomers wherein from about 50 percent to about 65 percent are tri-substituted olefins wherein one substituent contains from 2 to about 500 carbon atoms, often from about 30 to about 200 carbon atoms, more often from about 50 to about 100 carbon atoms, usually aliphatic carbon atoms, and the other two substituents are lower alkyl.

When the olefin is a tri-substituted olefin, it frequently comprises a mixture of cis- and trans-1-lower alkyl, 1-(aliphatic hydrocarbyl containing from 30 to about 100 carbon atoms), 2-lower alkyl ethylene and 1,1-di-lower alkyl, 2-(aliphatic hydrocarbyl containing from 30 to about 100 carbon atoms) ethylene.

In one embodiment, the monoolefinic groups are vinylidene groups, i.e., groups of the formula

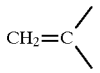

although the polybutenes may also comprise other olefinic configurations.

In one embodiment the polybutene is substantially monoolefinic, comprising at least about 30 mole %, preferably at least about 50 mole % vinylidene groups, more often at least about 70 mole % vinylidene groups. Such materials and methods for preparing them are described in U.S. Pat. Nos. 5,286,823 and 5,408,018, which are expressly incorporated herein by reference. They are commercially available, for example under the tradenames Ultravis (BP Chemicals) and Glissopal (BASF). These polybutenes are characterized as being high vinylidene polybutenes. Conventional polybutenes have about 5 mole % terminal vinylidene groups and are usually formed by $AlCl_3$ catalyzed polymerization.

As is apparent from the foregoing, olefins of a wide variety of type and molecular weight are useful for preparing the compositions of this invention. Useful olefins are usually substantially hydrocarbon and have number average molecular weight ($\overline{M}_n$) ranging from about 100 to about 70,000, more often from about 300 to about 20,000, even more often from about 300 to about 5,000 and frequently from about 900–2,500.

Specific characterization of olefin reactants (V) used in the processes of this invention can be accomplished by using techniques known to those skilled in the art. These techniques include general qualitative analysis by infrared and determinations of average molecular weight, e.g., $\overline{M}_n$, number average molecular weight, etc., employing vapor phase osmometry (VPO) and gel permeation chromatography (GPC). Structural details can be elucidated employing proton and carbon 13($^{13}C$) nuclear magnetic resonance (NMR) techniques. NMR is useful for determining substitution characteristics about olefinic bonds, and provides some details regarding the nature of the substituents. More specific details regarding substituents about the olefinic bonds can be obtained by cleaving the substituents from the olefin by, for example, ozonolysis, then analyzing the cleaved products, also by NMR, GPC, VPO, and by infra-red analysis and other techniques known to the skilled person.

The carboxylic reactant is at least one member selected from the group consisting of compounds of the formula $$R^3C(O)(R^4)_nC(O)OR^5 \quad \text{(II)}$$

and compounds of the formula $$R^3-\underset{\underset{HO}{|}}{\overset{\overset{R^9O}{|}}{C}}-(R^4)_n-C(O)OR^5 \quad \text{(IV)}$$

wherein each of $R^3$, $R^6$ and $R^9$ is independently H or a hydrocarbyl group, R is a divalent hydrocarbylene group, and n is 0 or 1. Specific embodiments of the groups $R^3$ and $R^5$ are set forth hereinabove where corresponding groups in the compound (I) are described. $R^9$ is preferably H or lower alkyl. A preferred reactant is glyoxylic acid methylester methyhemiacetal.

Examples of carboxylic reactants (B) are glyoxylic acid, carboxy aromatic aldehydes, such as 4-carboxybenzaldehyde, and other omega-oxoalkanoic acids, keto alkanoic acids such as pyruvic acid, levulinic acid, ketovaleric acids, ketobutyric acids and numerous others. The skilled worker, having the disclosure before him, will readily recognize the appropriate compound of formula (IV) to employ as a reactant to generate a given intermediate. Preferred compounds of formula (IV) are those that will lead to preferred compounds of (C).

Reactant (B) may be a compound of the formula $$R^3-\underset{\underset{HO}{|}}{\overset{\overset{HO}{|}}{C}}-(R^4)_n-C(O)OR^5 \quad \text{(VI)}$$

wherein each of $R^3$ and $R^5$ is independently H or hydrocarbyl preferably H or alkyl. Such compounds arise when the carboxylic reactant is hydrated. Glyoxylic acid monohydrate is a representative example.

From the foregoing, it is apparent that the various 'R' groups in the carboxylic reaction products (C) correspond to the same groups in the olefinic and carboxylic reactants.

The process of this invention whereby (C) is prepared by reacting (A) and (B) is conducted at temperatures ranging from ambient up to the lowest decomposition temperature of any of the reactants, usually from about 60° C. to about 220° C., more often from about 120° C. to about 160° C. When the reaction is conducted in the presence of organic sulfonic acid or mineral acid catalyst, the reaction is usually conducted at temperatures up to about 150° C., often up to about 120° C., frequently from about 120° C. up to about 130° C. The process employs from about 0.5 moles of reactant (B) per mole of substituted carboxylic acylating agent (A), to about 3.0 moles (B) per equivalent of (A), more often from about 0.8 moles (B) per mole of (A) to about 1.2 moles (B) per equivalent of (A), even more often from about 0.95 moles (B) per mole of (A) to about 1.05 moles (B) per equivalent of (A). In order to maximize yield of product of this invention, it is generally desirable to conduct the reaction at as low a temperature as possible. As noted herein, many reactants contain water which is removed. Removal of water at moderate temperatures is attainable employing reduced pressure, a solvent that aids in azeotropic distillation of water, or by purging with an inert gas such as $N_2$.

The progress of the reaction can be followed by observing the infra-red spectrum. The absorption for -COOH carbonyl of the products appears at about 1710 $cm^{-1}$. The total acid number as measured using essentially the procedure in ASTM D-664 (Potentiometric Method) or ASTM D-974 (Color Indicator Method) is useful together with the infrared, keeping in mind that non-acidic products (e.g., polyester products), those derived from non-acidic reactants and condensation products such as lactones will not display significant acid numbers. However, ASTM method D-94 measures SAP (saponification number) of carboxylic materials whether such materials are acidic or not.

For the synthesis of carboxylic reaction products (C) formed under optionally acid catalyzed conditions by reacting (A), a substituted carboxylic acylating agent with (B), a carboxylic reactant the preferred reactants are: (A) polyisobutylene of $\overline{M}^n$200–3,000 substituted maleic anhydrides: (B) glyoxylic acid or its monohydrate or glyoxylic acid methylester methylhemiacetal. It should be noted that (A) may also contain the polyisobutylene as such which will also react with (B). It will be further noted that reaction product (C) may be further reacted with an α-β unsaturated acid or anhydride to form second carboxylic reaction products (D). Products (C) and (D) may then be further reacted with a reactant selected from groups (a)–(d) as recited hereinabove to form reaction products (E).

It is pointed out that to (A), which may already contain a polyolefin by virtue of its formation from a polyolefin and α-β unsaturated compound, a polyolefin may be added to (A) prior to reaction with said carboxylic reactant (B).

For the further reaction of carboxylic reaction products (C) with an α-β unsaturated compound to form (D), maleic acid or maleic anhydride are the preferred α-β unsaturated compounds. This reaction may be carried out under thermal or free radical conditions. These reactions are described in detail in our co-pending U.S. patent application Ser. No. 08/870,350 which was filed on the same day as the instant application. This application is herein incorporated by reference for its disclosure of radical and thermal catalyzed reactions of α-β unsaturated compounds.

The carboxylic reaction products (C) and (D) of this invention may be used as such in lubricants or fuels, or they may be further reacted with reactants as recited below to form further reaction products (E). The reactant is selected from the group consisting of (a) amine characterized by the presence within its structure of at least one H-N<group, (b) alcohol, (c) reactive metal or reactive metal compound, (d) a combination of two or more of any (a) through (c), the components of (d) being reacted with said substituted acylating agent either sequentially or simultaneously in any order. Ammonia and hydrazine are included in the above reactant groups. For a full disclosure of reactions of substituted acylating agents with (a)–(d) above we incorporated herein by reference U.S. Pat. No. 4,234,435.

Suitable reactants, to further react with (C) and (D) to form (E) include ammonia, hydrazines, monoamines or polyamines. The reactants must contain at least one N-H group.

The monoamines generally contain from 1 to about 24 carbon atoms, preferably 1 to about 12, and more preferably 1 to about 6. Examples of monoamines useful in the present invention include primary amines, for example methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary monoamines will not result in formation of an amide, but can form salts with carboxylic acids.

In another embodiment, the monoamine may be a hydroxyamine. Typically, the hydroxyamines are primary or secondary amines or mixtures thereof. As stated above, tertiary monoamines will not react to form amides; however tertiary alkanol monoamines sometimes can react to form a tertiary amino group containing ester. Hydroxy amines that can react to form amide can be represented, for example, by the formulae:

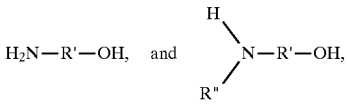

wherein each R" is independently a hydrocarbyl group, preferably alkyl or alkenyl, of one to about 22 carbon atoms or a hydroxyhydrocarbyl group, preferably aliphatic, of two to about 22 carbon atoms, preferably one to about four, and R' is a divalent hydrocarbyl group, preferably an alkylene group, of about two to about 18 carbon atoms, preferably two to about four. Typically, each R is independently a methyl, ethyl, propyl, butyl, pentyl or hexyl group. The group —R'—OH in such formulae represents the hydroxyhydrocarbyl group. R' can be acyclic, alicyclic or aromatic. Typically, R' is an acyclic straight or branched alkylene group such as an ethylene, 1,2-propylene, 1,2-butylene, 1,2-octadecylene, etc.

Examples of these alkanolamines include mono- and diethanolamine, 2-(ethylamino)ethanol, 2-(butylamino) ethanol, etc.

Hydroxylamine ($H_2N$—OH) is a useful condensable monoamine.

The hydroxyamines can also be ether-containing N-(hydroxyhydrocarbyl) amines. These are hydroxy poly (hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

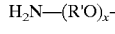

and

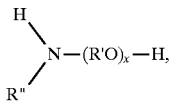

wherein x is a number from about 2 to about 15 and $R_4$ and R' are as described above. R" may also be a hydroxypoly (hydrocarbyloxy) group.

Other useful amines include ether amines of the general formula wherein $R^a$ is a hydrocarbyl group, preferably an aliphatic group, more preferably an alkyl group, containing from 1 to about 24 carbon atoms, R' is a divalent hydrocarbyl group, preferably an alkylene group, containing from two to about 18 carbon atoms, more preferably two to about 4 carbon atoms and $R^b$ is H or hydrocarbyl, preferably H or aliphatic, more preferably H or alkyl, more preferably H. When $R^b$ is not H, then it preferably is alkyl containing from one to about 24 carbon atoms. Examples of ether amines include, but are not limited to, hexyloxypropylamine, dodecyloxypropylamine, octyloxypropylamine, and N-decyloxypropyl-1,3-diamino propane. Ether amines are available from Tomah Products, Inc. and under the name SURFAM produced and marketed by Sea Land Chemical Co., Westlake, Ohio.

The amine may be an amino heterocycle. Examples include aminopyridine, aminopropylimidazole, aminopyrimidine, amino-mercaptothiadiazoles, and aminotriazole.

The amine may also be a polyamine. The polyamine contains at least two basic nitrogen atoms and is characterized by the presence within its structure of at least one HN<group. Mixtures of two or more amino compounds can be used in the reaction. Preferably, the polyamine contains at least one primary amino group (i.e., —$NH_2$) and more preferably is a polyamine containing at least two condensable—NH— groups, either or both of which are primary or secondary amine groups. The polyamine may be aliphatic, cycloaliphatic, heterocyclic or aromatic. Examples of the polyamines include alkylene polyamines, hydroxy containing polyamines, arylpolyamines, and heterocyclic polyamines.

Among the preferred polyamines are the alkylene polyamines, including the polyalkylene polyamines. The alkylene polyamines include those conforming to the formula

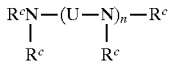

wherein n is from 1 to about 10; preferably about 2 to about 7, more preferably about 2 to about 5, each U is independently hydrocarbylene, preferably alkylene having from 1 to about 10 carbon atoms, often from about 2 to about 6, more preferably from about 2 to about 4 carbon atoms, each $R^c$ is independently a hydrogen atom, a hydrocarbyl group, preferably aliphatic, or a hydroxy-substituted or amine-substituted hydrocarbyl group, preferably aliphatic, having up to about 30 atoms, or two $R^c$ groups on different nitrogen atoms can be joined together to form a U group, with the proviso that at least one $R^c$ group is hydrogen. Preferably U is ethylene or propylene. Especially preferred are the alkylene polyamines where each $R^c$ is hydrogen, lower alkyl, or an amino-substituted hydrocarbyl group, preferably aliphatic, with the ethylene polyamines and mixtures of ethylene polyamines being the most preferred.

Alkylene polyamines include methylene polyamines, ethylene polyamines, butylene polyamines, propylene polyamines, pentylene polyamines, etc. Higher homologs and related heterocyclic amines such as piperazines and N-amino alkyl-substituted piperazines are also included. Specific examples of such polyamines are ethylene diamine, diethylene triamine, triethylene tetramine, tris-(2-aminoethyl)amine, propylene diamine, trimethylene diamine, tripropylene tetramine, tetraethylene pentamine, hexaethylene heptamine, pentaethylenehexamine, aminoethyl piperazine, dimethyl aminopropylamine, etc.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74–108, John Wiley and Sons, New York (1993) and in Meinhardt, et al, U.S. Pat. No. 4,234,435, both of which are hereby incorporated herein by reference for disclosure of useful polyamines. Such polyamines are conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. The mixtures are particularly useful. On the other hand, quite satisfactory products can be obtained by the use of pure alkylene polyamines. Ethylene polyamine mixtures are useful.

Other useful types of polyamine mixtures are those resulting from stripping of the above-described polyamine mixtures removing lower molecular weight polyamines and volatile components to leave as residue what is often termed "polyamine bottoms". In general, alkylene polyamine bottoms can be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample showed it contains about 0.93% "Light Ends" (most probably diethylenetriamine), 0.72% triethylenetetramine, 21.74% tetraethylene pentamine and 76.61% pentaethylene hexamine and higher (by weight). These alkylene polyamine bottoms include cyclic condensation products such as piperazine and higher analogs of diethylene triamine, triethylenetetramine and the like.

In another embodiment, the polyamines are hydroxy-containing polyamines provided that the polyamine contains at least one condensable —N—H group. Hydroxy-containing polyamine analogs of hydroxy monoamines, particularly alkoxylated alkylenepolyamines can also be used. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2- hydroxyethyl) ethylenediamine, N,N-di-(2-hydroxyethyl)-ethylenediamine, 1-(2-hydroxyethyl) piperazine, mono-(hydroxypropyl)-substituted tetraethylene-pentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

The polyamines may be polyoxyalkylene polyamines, including polyoxyethylene and polyoxypropylene diamines and the polyoxypropylene triamines having average molecular weights ranging from about 200 to about 2000. Polyoxyalkylene polyamines are commercially available, for example under the tradename "Jeffamines" from Texaco Chemical Co. U.S. Pat. Nos. 3,804,763 and 3.948,800 contain disclosures of polyoxyalkylene polyamines and are incorporated herein by reference for their disclosure of such materials.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroirnidazoles, piperazines, isoindoles, purines, N-aminoalkylmorpholines, N-aminoalkylthiomorpholines, N-aminoalkylpiperazines, N,N'-bisaminoalkyl piperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethyl-piperazine. Hydroxy alkyl substituted heterocyclic polyamines are also useful. Examples include N-hydroxyethylpiperazine and the like.

In another embodiment, the amine is a polyalkene-substituted amine. These polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines i and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxy-propyl)-N-polybutene amine; N-polybutene-aniline; N-polybutenemorpholine; N-poly(butene) ethylenediamine; N-poly(propylene)trimethylenediamine; N-poly (butene)diethylene-triamine; N',N'-poly(butene) tetraethylenepentamine; N,N-dimethyl-N'-poly-(propylene) -1,3-propylenediamine and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by an n (number average molecular weight) value of at least about 500. Generally, the polyalkene substituted amine is characterized by an n value of about 500 to about 5000, preferably about 800 to about 2500. In another embodiment n varies between about 500 to about 1200 or 1300.

The polyalkenes from which the polyalkene substituted amines are derived include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the polymer is a homopolymer. An example of a preferred homopolymer is a polybutene, preferably a polybutene in which about 50% of the polymer is derived from isobutylene. The polyalkenes are prepared by conventional procedures.

Another useful polyamine is a condensation product obtained by reaction of at least one hydroxy compound with at least one polyamine reactant containing at least one primary or secondary amino group. These condensation products are characterized as being a polyamine product having at least one condensable primary or secondary amino group, made by contacting at least one hydroxy-containing material (b-i) having the general formula $$(R)_nY_z—X_p—(A(OH)_q)_m \quad (I)$$

wherein each R is independently H or a hydrocarbon based group, Y is selected from the group consisting of O, N, and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N-H group.

The hydroxy material (b-i) can be any hydroxy material that will condense with the amine reactants (b-ii). These hydroxy materials can be aliphatic, cycloaliphatic, or aromatic; monools and polyols. Aliphatic compounds are preferred, and polyols are especially preferred. Highly preferred are amino alcohols, especially those containing more than one hydroxyl group. Typically, the hydroxy-containing material (b-i) contains from 1 to about 10 hydroxy groups.

Monools useful as (b-i) are primary or secondary, preferably alkyl, monohydric compounds, preferably containing from 1 to about 100 carbon atoms, more preferably up to about 28 carbon atoms. Examples include methanol, ethanol, butanols, cyclohexanol, 2-methylcyclohexanol, isomeric octanols and decanols, octadecanol, behenyl alcohol, neopentyl alcohol, benzyl alcohol, beta-phenylethyl alcohol, and chloroalkanols.

Further examples are monoether- and polyether-containing monools derived from oxyalkylation of alcohols, carboxylic acids, amides, or phenolic materials, by reaction with alkylene oxides. When two or more different alkylene oxides are employed, they may be used as mixtures or consecutively, as discussed in greater detail hereinbelow. These ether-containing monools can be represented by the general structure:

$$R\text{-}(OR^d)_a\text{-}(OR^e)_b\text{-}(OR^f)_c\text{-}OH$$

wherein R=hydrocarbyl, acyl, or carboxamidoalkyl; preferably containing from 1 to about 28 carbon atoms, each of $R^d$, $R^e$ and $R^f$ is hydrocarbylene containing from 2 to about 12 carbon atoms, more often 2 or 3 carbon atoms; a, b, and c=0–100, provided that the total of a, b, and c is at least 1. When R is hydrocarbyl, it may be alkyl-, aryl-, arylalkyl-, or alkylaryl-. In one embodiment, a and b may from zero to about 12, preferably from zero to about 6, while in another embodiment, a and b range up to about 100.

Examples include 2-alkoxyethanols, members of the "Cellosolve" family of glycol ethers made by Union Carbide Corporation, and 2-(polyalkoxy)ethanol. Other commercially available products of alcohol alkoxylation include Neodol® ethoxylated linear and branched alcohols from Shell Chemical, Alfonic® ethoxylated linear alcohols from Vista Chemical, propoxylated alcohols from ARCO Chemicals, UCON® propoxylated alcohols from Union Carbide, Provol® propoxylated fatty alcohols from Croda Chemical, and Carbowax methoxy polyethylene glycols, such as Carbowax® 350 and 750 from Union Carbide.

Aryl analogs of lower ether-containing monools include, for example, 2-(nonylphenoxyethyloxy)ethanol, 2-(octylphenoxyethyl-oxyethyloxy)ethanol and higher homologs made using greater amounts of alkylene oxides, marketed under the TRITON® trademark by Union Carbide.

As noted hereinabove, polyether monools may also be prepared by condensation of 2 or more different alkylene oxides, in mixtures or consecutively, with alcohols, alkylphenols or amides. Commercially available polyether monools made from reaction of mixtures of ethylene oxide and propylene oxide with butanol are represented by the UCON®50-HB- and 75-HB-series of functional fluids from Union Carbide, while similar products from mixtures of propylene oxide and higher (e.g., $C_4$–$C_{10}$) alkylene oxides are sold by BP Chemicals under the Breox® tradename.

Polyols are defined herein as compounds containing at least two hydroxy groups.

Dihydroxy compounds include alkylene glycols of general structure HO—(—R—)—OH, wherein R is hydrocarbylene. Examples are ethylene glycol, 1,2-propanediol, 1,2-, 1,3- and 1,4-butylenediols, 1,6-hexanediol, neopentylene glycol, 1,10-decanediol, cyclohexane-1,4-diol and 1,4-bis-(hydroxymethyl) cyclohexane.

Other diols include ether-diols and polyether diols (glycols). These may be represented by the general structure:

$$HO\text{-}(OR^d)_a\text{-}(OR^e)_b\text{-}(OR^f)_c\text{-}OH$$

wherein $R^d$, $R^e$ and $R^f$ are independently $C_2$–$C_{12}$ hydrocarbylene, more often ethylene or propylene, and a, b and c are independently zero to about 100, provided that the total of a, b, and c is at least 1. Examples of ether- and polyether- diols are diethylene glycol, triethylene glycol, tetraethylene glycol, dipropylene glycol, 2-(2-hydroxyethyloxy)-1-propanol and 1,2-bis-(2-hydroxypropyloxy)ethane, polyoxy-alkylene oxides of the Carbowax® family of polyethylene glycols from Union Carbide, the Pluronic® P-series of polypropylene oxide diols from BASF, polyoxybutylene glycols from Dow Chemical, and the like.

In addition to monools and diols, other useful alcohols include polyhydric alcohols having three or more HO—groups, preferably those containing up to about 12 carbon atoms, and especially those containing from about 3 to about 10 carbon atoms. Useful polyhydric polyols include, glycerol, trimethylol propane, 2-ethyl-2-hydroxymethyl-1,3-propanediol, erythritol, pentaerythritol, dipentaerythritol, glucose, arabinose, 1,2,3-hexane triol, 2,3,4-hexanetriol, butanetriols, and polyglycerols (including the ether-coupled glycerol dimer, trimer, tetramer, etc.)

Amino alcohols are useful hydroxy containing compounds. Amino alcohols may be aliphatic, cycloaliphatic or aromatic, containing at least one hydroxy group and preferably containing two or more hydroxy groups. These may be prepared by methods known in the art, for example, by reaction of an amine having at least one N-H group with an alkylene oxide. Another procedure is to condense an aldehyde, particularly formaldehyde, with a nitro compound followed by reduction of nitro groups.

Useful amino alcohols include monoamino and polyamino compounds. These may be monohydroxy or polyhydroxy compounds, depending, for example on the extent of reaction with alkylene oxide. For example, a primary amine may react with one or two alkylene oxides, forming mono- or di-hydroxyalkylamines. Polyalkoxy ether containing amino alcohols are also useful. These may be prepared by reaction of ammonia or a primary or secondary amine with an excess of alkylene oxide.

Some of the more useful amino alcohols are the reduced condensation products of formaldehyde with nitroalkanes. Particularly useful are 2-amino-2-(2-hydroxymethyl)-1,3-propane-diol (commonly known as "THAM", or "TrisAmino"), 2-amino-2-ethyl-1,3-propanediol, and 2-amino-2-methyl-1,3-propanediol.

Examples of other useful amino alcohols include N-(N)-hydroxy-lower alkyl) amines and polyamines such as di-(2-hydroxyethyl) amine, aminoethanol, triethanolamine, dibutylaminoethanol, tris(hydroxypropyl)amine, N,N,N',N'-tetra-(hydroxyethyl)trimethylene-diamine, and the like.

Examples of commercially available oxyalkylated amines include members of the Ethomeen® and Propomeen® series of ethoxylated and propoxylated primary and secondary amines from AKZO Chemie. Ethylene diamine/propylene oxide products constitute the Tetronic® family of polyoxyalkylated diamine available from BASF/Wyandotte Corporation.

Reaction of ethylene oxide or propylene oxide with polyglycolamine from Union Carbide gives the corresponding di-(2-hydroxyalkyl)-ether amine. Similar reaction of these alkylene oxides with Jeffamine® polyoxypropylamines from Huntsman Chemical results in the formation of N-hydroxyalkylated derivatives. Corresponding products may be made by hydroxyalkylation of 3-(higher alkyloxy) propylamines.

Other useful hydroxy-containing reactants are hydroxyalkyl-, hydroxyalkyl oxyalkyl-, and corresponding aryl derivatives thereof, sulfides of the formula $$R-S_a\left(R^dO\right)_bH$$

wherein R is a hydrocarbyl or hydroxyhydrocarbyl group containing from 1 to about 22 carbon atoms, $R^d$ is a hydrocarbylene group containing 2 to 12 carbons, a is 1 or 2; and b ranges from 1 to about 20. Examples include 2-(dodecylthio)ethanol, thiodiethanol, and 2-hydroxyethyl disulfide.

The hydroxy compounds are preferably polyhydric alcohols and amines, preferably polyhydric amines. Polyhydric amines include any of the above-described monoamines reacted with an alkylene oxide (e.g., ethylene oxide, propylene oxide, butylene oxide, etc.) having two to about 20 carbon atoms, preferably 2 to about 4. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl) ethylenediamine, and N,N,N',N'-tetrakis(2-hydroxyethyl) ethylenediamine.

Among the preferred amines making up b(ii) are the alkylene polyamines, including the polyalkylene polyamines. In another embodiment, the polyamine may be a hydroxyamine provided that the polyamine contains at least one condensable—N-H group.

Preferred polyamine reactants include triethylenetetramine (TETA), tetraethylenepentamine (TEPA), pentaethylenehexamine (PEHA), and mixtures of polyamines such as the above-described "amine bottoms".

Preferred combinations of reactants for making the polyamine product include those in which reactant (b-i) is a polyhydric alcohol having three hydroxyl groups or an amino alcohol having two or more hydroxy groups and reactant (b-ii) is an alkylene polyamine having at least two primary nitrogen atoms and wherein the alkylene group contains 2 to about 10 carbon atoms.

The reaction is conducted in the presence of an acid catalyst at an elevated temperature. Catalysts useful for the purpose of this invention include mineral acids (mono, di- and poly basic acids) such as sulfuric acid and phosphoric acid; organophosphorus acids and organo sulfonic acids, alkali and alkaline earth partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; $CaHPO_4$, $CaSO_4$ and $MgHPO_4$; also $Al_2O_3$ and Zeolites. Phosphorus and phosphoric acids and their esters or partial esters are preferred because of their commercial availability and ease of handling. Also useful as catalysts are materials which generate acids when treated in the reaction mixture, e.g., triphenylphosphite. Catalysts are subsequently neutralized with a metal-containing basic material such as alkali metal, especially sodium, hydroxides.

The reaction to form the polyamine products is run at an elevated temperature which can range from 60° C. to about 265° C. Most reactions, however, are run in the 220° C. to about 250° C. range. The reaction may be run at atmospheric pressure or optionally at a reduced pressure. The degree of condensation of the resultant high molecular weight polyamine prepared by the process is limited only to the extent to prevent the formation of solid products under reaction conditions. The control of the degree of condensation of the product of the present invention is normally accomplished by limiting the amount of the condensing agent, i.e., the hydroxyalkyl or hydroxy aryl reactant charged to the reaction. The resulting product frequently contains the neutralized catalyst and significant amounts by weight, from about 0.1%, often at least 1%, frequently 5% up to 20%, often up to 10%, water.

The amine condensates and methods of making the same are described in Steckel (U.S. Pat. No. 5,053,152) which is incorporated by reference for its disclosure to the condensates and methods of making.

Further reaction products (E), prepared by reacting (C) and (D) of this invention with an amine as described above are post-treated by contacting the compositions of (E) thus formed with one or more post-treating reagents selected from the group consisting of boron oxide, boron oxide hydrate, boron halides, boron acids, esters of boron acids, carbon disulfide, sulfur, sulfur chlorides, alkenyl cyanides, carboxylic acid acylating agents, aldehydes, ketones, urea, thio-urea, guanidine, dicyanodiamide, hydrocarbyl phosphates, hydrocarbyl phosphites, hydrocarbyl thiophosfides, phosphorus oxides, phosphoric acid, hydrocarbyl thiocyanates, hydrocarbyl isocanates, hydrocarbyl isothiocyanates, epoxides, episulfides, formaldehyde or formaldehyde-producing compounds plus phenols, and sulfur plus phenols. The same post-treating reagents are used with carboxylic derivative compositions prepared from the acylating reagents of this invention and a combination of amines and alcohols as described above. However, when the carboxylic derivative compositions of this invention are derived from alcohols and the acylating reagents, that is, when they are acidic or neutral esters, the post-treating reagents are usually selected from the group consisting of boron oxide, boron oxide hydrate, boron halides, boron acids, esters of boron acids, sulfur, sulfur chlorides, phosphorus sulfides, phosphorus oxides, carboxylic acid acylating agents, epoxides, and episulfides.

Since post-treating processes involving the use of these post-treating reagents is known insofar as application to reaction products of high molecular weight carboxylic acid acylating agents of the prior art and amines and/or alcohols, detailed descriptions of these processes herein is unnecessary. In order to apply the prior art processes to the carboxylic derivative compositions of this invention, all that is necessary is that reaction conditions, ratio of reactants, and the like as described in the prior art, be applied to the novel carboxylic derivative compositions of this invention. U.S. Pat. No. 4,234,435 is incorporated herein by reference for disclosure of post-treating dispersants formed from the reactions of (C) and (D) with amines, alcohols and metallic compositions as described hereinabove.

EXAMPLES

Starting Succans

Example I (For substituted carboxylic acylating agent (A))

To a reactor was charge 404.1 parts of a polyisobutene ( $\overline{M}_n$=1000) and 101 parts hexanes. To this mixture was added 9.5 parts gaseous chlorine beneath the surface evenly over 1.7 hours followed by nitrogen at the same flow rate for 0.5 hour. The hexanes (495 parts) were distilled off at ambient pressure from 68°–140° C. A portion (374.7 parts) of this mixture was transferred to a second reactor along with 95.4 parts maleic anhydride and the reaction mixture heated to 200° C. and held a 200° C. for 24 hours. The reaction mixture was then stripped at 200° C. at reduced pressure (20 torr). The resulting residue is a desired substituted carboxylic acylating agent.

Example 2 (For substituted carboxylic acylating agent (A))

To a reactor was charge 1000 parts of a polyisobutene ( $\overline{M}_n$=2200) and 44.5 parts maleic anhydride. This mixture was heated to 120° C. and 24 parts gaseous chlorine added evenly over seven hours during which the reactions temperature was maintained between 120°–130° C. The reaction temperature was raised linearly from 130° C. to 190° C. over ten hours and held at 190° C. for 7 hours. The reaction mixture was then raised to 205° C. over 2 hours and held at 205° C. for 6 hours during which the mixture was stripped with a nitrogen blow during the last four hours at 205° C. The residue (Sap no. 47) is a desired substituted carboxylic acylating agent.

Example 3 (For substituted carboxylic acylating agent (A))

To a reactor was charged 990.2 parts of a polyisobutene ($\overline{M}_n$=2152) having about 80% vinylidene type end groups and 112.6 parts maleic anhydride. This mixture was heated to 200° C. over 3 hours and held at 200° C. for 24 hours. The reaction mixture was cooled to 190° C. and vacuum stripped (20 torr) at 190° C. for 2 hours. The residue was filtered through filter aid. The filtrate (Sap no. 65) is a desired substituted carboxylic acylating agent.

Example 4 (For substituted carboxylic acylating agent (A))

To a reactor was charged 1004.2 parts of a polyisobutene ($\overline{M}_n$=2152) having about 80% vinylidene type end groups and 41.4 parts maleic anhydride. This mixture was heated to 200° C. over 3 hours and held at 200° C. for 24 hours. The reaction mixture was cooled to 190° C. and vacuum stripped (20 torr) at 190° C. for 2 hours. The residue was filtered through filter aid. The filtrate (Sap no. 35) is a desired substituted carboxylic acylating agent.

Example 5 (For substituted carboxylic acylating agent (A))

To a reactor was charged 7410 parts of a polyisobutene ( $\overline{M}_n$=1000) and 382 parts maleic anhydride. This mixture was heated to 203° C. over 5 hours and held at 203° C. for 24 hours. The mixture was stripped at 210° C. a reduced pressure (2 mm Hg) for 1 hour. The residue (Sap no. 94) is a desired substituted carboxylic acylating agent.

Example 6 (For substituted carboxylic acylating agent (A))

To a reactor was charged 7410 parts of a polyisobutene ( $\overline{M}_n$=2000) and 764 parts maleic anhydride. This mixture was heated to 203° C. over 5 hours and held at 203° C. for 24 hours. The mixture was stripped at 210° C. a reduced pressure (2 mm Hg) for 1 hour. The residue (Sap no. 39) is a desired substituted carboxylic acylating agent.

EXAMPLES

Glyoxylate Derivatives

Example 7 ( For the carboxylic reaction product (C))

Into a four-necked flask was charge 267 parts (0.25 mol, Sap no 104) ) of a polyisobutenyl succinic anhydride from Example 1, 29.8 parts (0.25 mol) glyoxylic acid methyl ester methylhemiacetal, and 2.0 parts 70% aqueous methanesulfonic acid. This mixture was heated to 150° C. and held at 150° C. for 9 hours while collecting the distillate in a Dean Stark trap. The reaction was stripped at 150° C. under reduced pressure (6 mm Hg) for 2 hours. The reaction mixture was filtered through filter aid. The filtrate (Sap no. 136) is a desired carboxylic reaction product.

Example 8 (For the carboxylic reaction product (C))

The procedure for Example 8 is repeated except the substituted carboxylic acylating agent from Example 7 is replaced on an equimolar basis by the substituted carboxylic acylating agent Example 8. The resulting product had Sap no. 72.

Example 9 (For the carboxylic reaction product (C))

The procedure for Example 8 is repeated except the substituted carboxylic acylating agent from Example 7 is replaced on an equimolar basis by the substituted carboxylic acylating agent Example 2 and a mole ratio of 1:0.6 polyisobutenyl succinic anhydride to glyoxylic acid methyl ester methylhemiacetal was used. The resulting product had Sap no. 63.

Example 10 ( For the carboxylic reaction product (C))

The procedure for Example 7 is repeated except the substituted carboxylic acylating agent from Example 7 is replaced on an equimolar basis by the substituted carboxylic acylating agent Example 3 and a mole ratio of 1:1.2 polyisobutenyl succinic anhydride to glyoxylic acid methyl ester methylhemiacetal was used. The resulting product had Sap no.89.

Example 11 ( For the carboxylic reaction product (C))

The procedure for Example 7 is repeated except the substituted carboxylic acylating agent from Example 7 is replaced on an equimolar basis by the substituted carboxylic acylating agent Example 4. The resulting product had Sap no. 44.2.

Example 12 ( For the carboxylic reaction product (C))

To a reactor was charge 500 parts (0.42 equivalents; Sap no. 94) of a polyisobutenyl succinic anhydride from Example 5. This material was heated to 80° C. and 62 parts (0.42 equivalents) of glyoxylic acid added dropwise over 0.5 hours. The reaction mixture was then heated to 160° C., held at 160° C. for 6 hours and filtered through filter aid. The filtrate (Sap no. 115) is a desired carboxylic reaction product.

Example 13 ( For the carboxylic reaction product (C))

To a reactor was charge 500 parts (0.42 equivalents; Sap no. 94) of a polyisobutenyl succinic anhydride from Example 5. This material was heated to 90° C. and 123 parts (0.83 equivalents) of glyoxylic acid added dropwise over 0.5 hours. The reaction mixture was then heated to 150° C. over 3 hours, held at 150° C. for 3 hours and filtered through filter aid. The filtrate (Sap no. 129) is a desired carboxylic reaction product.

Example 14 ( For the carboxylic reaction product (C))

The procedure for Example 8 is repeated except the substituted carboxylic acylating agent from Example 7 is replaced on an equimolar basis by the substituted carboxylic acylating agent Example 6 and a mole ratio of 1:1.2 polyisobutenyl succinic anhydride to glyoxylic acid methyl ester methylhemiacetal was used. The resulting product had Sap no. 48.1.

Example 15

To a one liter flask was added 470 grams (0.418 equivalent) of a polyisobutylene substituted succinic anhydride of molecular weight about 1,100 and 46 grams (0.5 equivalent) of glyoxylic acid monohydrate. The mixture was heated under nitrogen for 16 hours at 170°–180° C. and 15 grams of distillate were collected in a Dean Stark trap. The reaction was stripped at 180° C. and 2 mm mercury for 1 hour. 308 grams of diluent oil was added and the mixture filtered through filter aid. Example 16

The reaction of Example 1 was repeated using one equivalent of glyoxylic acid hydrate and 0.5 equivalent of the substituted carboxylic acylating agent. The mixture was heated at 190°–200° C. for 2 hours and 180°–185° C. for 14 hours. During heating 38 grams of distillate was collected in a Dean Stark trap. The product was stripped two hours and 412 grams diluent oil added and the product filtered through filter aid.

Example 17

Reactions similar to those described in Examples 1 and 2 above were conducted with a polyisobutylene substituted acylating agent of molecular weight of about 2,166 using 0.49 equivalent of glyoxylic acid monohydrate and 0.39 equivalent of the substituted succinic anhydride. The reaction was conducted at 180°–190° C. for 36 hours, stripped at reduced pressure and diluted with oil and filtered through filter aid.

Any of the products from Examples 1–3 above, the polyisobutylene substituted succinic anhydride (A) which had been reacted with carboxylic reactants (B) to produce carboxylic reaction products (C) are further reactable with (a)–(d) as described hereinabove and in U.S. Pat. No. 4,234,435 where said reactants include also $NH_3$ and hydrazine. However, the preferred reactants to react with (C) are polyamines.

EXAMPLES

Amine Derivatives

Example 18 (The polyamine Derivatives of (C))

Into a four-necked flask was charged the carboxylic reaction product of Example 12, 150 grams (0.44 equivalents, equivalent weight of 342 determined by SAP number) and 160 grams 100N diluent oil. This mixture was heated to 100° C. and 13.8 grams (0.33 equivalents, equivalnet weight of 42) of polyamine were added. The reaction mixture was heated to 150° C. and held at 150° C. for five hours under nitrogen purge while collecing distillate in a Dean Stark trap. The reaction was cooled to 140° C. and filtered through filter aid to give the praduct as the filtrate.

Example 19 (The polyamine Derivatives of (C))

The procedure for Example 15 is repeated except the carboxylic reaction product from Example 15 is replaced on an equimolar basis by the carboxylic reaction product Example 13.

Example 20

The procedure for Example 15 is repeated except the carboxylic reaction product from Example 15 is replaced on an equimolar basis by the carboxylic reaction product Example 14 and an equivalents ratio of 1:1.5 of the carboxylic reaction product to polyamine was used.

Example 21 (The polyamine Derivatives of (C))

The procedure for Example 15 is repeated except the carboxylic reaction product from Example 15 is replaced on an equinolar basis by the carboxylic reaction product Example 9 and an equivalents ratio of 1:1.3 of the carboxylic reaction product to polyamine was used.

Example 22

300 grams, 0.410 equivalent of the reaction product of Example 15 (equivalent weight 732 as determined by SAP number) was reacted with Union Carbide PM 1969 polyamine bottoms product to produce a dispersant. In this 21 grams (0.5 equivalent) of the polyamine was used.

The reaction was run in 150 ml xylene under nitrogen in a reaction flask having a Dean Stark trap for 20 hours at 170°–180° C. The reaction was stripped at 2 mm mercury for 2 hours at 170° C. The product was filtered through filter aid.

It will be recognized that the substituted carboxylic acylating agents formed by reacting polyolefins and maleic anhydride have residual polyolefin. The polyolefin in the acylating agent is roughly in the range of 5–25% by weight of the product depending on the method of synthesis. The reaction of polyolefins with (B) the carboxylic reactants takes place simultaneously with the polyolefin substituted succinic anhydride.

Those skilled in the art will realize that the chlorine free compositions (C) and (D) are novel and useful in fuels and lubricants, and that the derivatives (E) of (C) and (D) are further useful in fuels and lubricants. For use in fuels, the compositions (C) and (D) and dispersant derivatives thereof (E) are mixed in any fuel as is known to those skilled in the art at a level of about 5–15,000 parts per million. The compositions (C), (D) and (E) are normally dissolved in a fluidizer to make a concentrate at the level of about 5–95% by weight chemical of (C), (D) or (E) its further reaction products. The fluidizers used are diluent oils and inert stable oleophilic organic solvents boiling in the range of about 150° C. to 400° C. Preferably, for use in fuels an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the fuel concentrate, the amount of the additive will be ordinarily at least 5 percent by weight and generally not exceed 70 percent by weight, preferably from 5 to 50 and more preferably from 10 to 25 weight percent.

The diluent oils suitable for fluidizers are mineral or synthetic oils having kinematic 100° C. viscosity values of about 20 cSt to about 25 cSt. Synthetic oils include but are not limited to polyoxyalkylene mono and polyols, either derivatives thereof and N-vinylpyrrolidinone addition products thereof, polyalpha olefins and hydrogenated polyalpha-olefins.

The carboxylic reaction products (C) and (D) and their further reaction products (E) described hereinabove, and especially amine and polyamine derivatives (E) are mainly utilized in oils of lubricating viscosity. Reaction products (C) and (D) and their derivatives (E) described hereinabove are used in oils at levels of 0.1–20 weight percent on a chemical basis. The oils are well known to those familiar with the art and may be mineral, plant and synthetic oils or mixtures thereof. The carboxylic acylating agents (C) and (D) and their further reaction products (E) may be made up in concentrates having 5–95% of (C), (D) or (E) on a weight basis in diluent oil. The concentrates may then be added to a selected oil of lubricating viscosity.

We claim:

1. A composition of matter, said composition comprising:

(C) carboxylic reaction products formed by reacting (A) a substituted carboxylic acylating agent, with (B) a carboxylic reactant represented by the following formulae (III) or

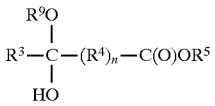

(IV)

wherein each of $R^3$, $R^5$ and $R^9$ is independently H or a hydrocarbyl group, $R^4$ is a divalent hydrocarbylene group, and n is 0 or 1.

2. A composition according to claim 1, wherein said substituted carboxylic acylating agent is substituted succinic acid or anhydride.

3. A composition according to claim 1, wherein said substituted carboxylic acylating agent is a polyolefin substituted carboxylic acylating agent, said polyolefin having $\overline{M}_n$ of 300–20,000.

4. A composition according to claim 3, wherein said substituted carboxylic acylating agent is a polybutene substituted succinic acylating agent, wherein said polybutene has an $\overline{M}_n$ of 200–5,000.

5. A composition according to claim 4, wherein said polybutene is selected from high vinylidene and conventional polybutene.

6. A composition according to claim 1, wherein said composition further comprises a polyolefin, wherein said polyolefin is used to form (A) or is an added polyolefin.

7. A composition according to claim 3, wherein said polyolefin is a polyolefin selected from the group consisting of (a) polyolefins derived from $C_2$–$C_{28}$ olefins and mixtures thereof; and (b) terpolymers.

8. A composition according to claim 1, wherein said reaction products (C) are further reacted with a reactant selected from the group consisting of (a) an amine characterized by the presence within its structure of at least one H-N<group including ammonia and hydrazine; (b) an alcohol; (c) a reactive metal or reactive metal compound; (d) a combination of two or more of (a) through (c); the components of (d) being reacted with said reaction products simultaneously or sequentially in any order.

9. A composition according to claim 8, wherein said amine is an ethylene polyamine.

10. A composition according to claim 1, wherein said carboxylic reactant (B) is selected from the group consisting of (a) glyoxylic acid, and (b) glyoxylic acid ester hemiacetals or mixtures thereof.

11. A composition according to claim 1, wherein said composition (C) is further reacted with an α-β unsaturated acid or anhydride to produce (D), second carboxylic reaction products.

12. A composition according to claim 11, wherein said second reaction products (D) are further reacted with a reactant selected from the group consisting of (a) an amine characterized by the presence within its structure of at least one H-N<group including ammonia and hydrazine; (b) an alcohol; (c) a reactive metal or reactive metal compound; (d) a combination of two or more of (a) through (c); the components of (d) being reacted with said reaction products simultaneously or sequentially in any order.

13. The composition according to claims 1 or 8 added in a minority amount to an oil of lubricating viscosity.

14. The composition according to claim 1 or 8 added to an inert organic solvent to form a concentrate.

15. The composition according to claim 1 or 8 added to a diluent oil to form a concentrate.

16. The composition of claim 11 or 12 added in a minority amount to an oil of lubricating viscosity.

17. The composition according to claim 11 or 12 added to an inert organic solvent to form a concentrate.

18. The composition according to claim 11 or 12 added to a diluent oil to form a concentrate.

19. The composition according to claim 12, wherein said amine is an ethylene polyamine.

20. The composition according to claim 5, wherein said polybutene comprises at least 30 mole % vinylidene groups.

21. The composition according to claim 5, wherein said polybutene comprises at least about 50 mole % vinylidene groups.

22. The composition according to claim 5, wherein said polybutene comprises at least about 70 mole % vinylidene groups.

* * * * *

UNITED STATES PATENT AND TRADEMARK OFFICE

CERTIFICATE OF CORRECTION

PATENT NO. : 5,851,966
DATED : December 22, 1998
INVENTOR(S) : BAKER et al.

It is certified that error appears in the above-identified patent and that said Letters Patent is hereby corrected as shown below:

Column 21, line 6: Insert the following:

(IV):

$$R^3C(O)(R^4)_nC(O)OR^5 \qquad (III)$$

Signed and Sealed this

Eighth Day of August, 2000

*Attest:*

*Attesting Officer*

Q. TODD DICKINSON

*Director of Patents and Trademarks*